US007235279B2

(12) United States Patent
Ogawa

(10) Patent No.: US 7,235,279 B2
(45) Date of Patent: Jun. 26, 2007

(54) PROCESS FOR PRODUCING A RADIATION IMAGE STORAGE PANEL

(75) Inventor: Hiroshi Ogawa, Kaisei-machi (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 09/797,800

(22) Filed: Mar. 5, 2001

(65) Prior Publication Data

US 2002/0009537 A1 Jan. 24, 2002

(30) Foreign Application Priority Data

Mar. 3, 2000 (JP) ..... 2000-058846

(51) Int. Cl.
*B05D 5/06* (2006.01)

(52) U.S. Cl. ..... 427/65

(58) Field of Classification Search ..... 427/65
See application file for complete search history.

(56) References Cited

U.S. PATENT DOCUMENTS

| | | | | |
|---|---|---|---|---|
| 4,188,449 | A * | 2/1980 | Lu et al. | 428/317.9 |
| 4,362,944 | A * | 12/1982 | Suzuki et al. | 250/483.1 |
| 4,952,813 | A * | 8/1990 | Miyahara et al. | 250/483.1 |
| 5,023,014 | A * | 6/1991 | Toda et al. | 252/301.4 H |
| 5,904,995 | A * | 5/1999 | Maezawa et al. | 428/690 |

FOREIGN PATENT DOCUMENTS

| | | | |
|---|---|---|---|
| CA | 1 243 534 | | 10/1988 |
| JP | 58-123634 | * | 7/1983 |
| JP | 59-126299 | | 7/1984 |
| JP | 59-126300 | | 7/1984 |

* cited by examiner

*Primary Examiner*—Timothy Meeks
*Assistant Examiner*—Jimmy Lin
(74) *Attorney, Agent, or Firm*—Sughrue Mion, PLLC

(57) ABSTRACT

A coating composition comprising at least a stimulable phosphor, a binder, and a mixed solvent is prepared. The mixed solvent comprises a low boiling temperature solvent having a viscosity of at most 0.6 mPa·s and a high boiling temperature solvent having a viscosity higher than 0.6 mPa·s, boiling temperatures of the low boiling temperature solvent and the high boiling temperature solvent being different by at least 10° C. from each other. The coating composition is applied onto a substrate and dried, and a stimulable phosphor layer is thereby formed on the substrate. The boiling temperature of the low boiling temperature solvent may be at most 110° C., and the boiling temperature of the high boiling temperature solvent may fall within the range of 110° C. to 220° C. The thus formed stimulable phosphor layer has uniform stimulable phosphor density, and a radiation image storage panel exhibiting little nonuniformity in light emission is capable of being produced.

2 Claims, No Drawings

PROCESS FOR PRODUCING A RADIATION IMAGE STORAGE PANEL

BACKGROUND OF THE INVENTION

1. Field of the Invention

This invention relates to a process for producing a radiation image storage panel for use in a radiation image recording and reproducing techniques, in which stimulable phosphors are utilized.

2. Description of the Related Art

In lieu of conventional radiography, radiation image recording and reproducing techniques utilizing stimulable phosphors have heretofore been used in practice. The radiation image recording and reproducing techniques are described in, for example, U.S. Pat. No. 4,239,968. The radiation image recording and reproducing techniques utilize a radiation image storage panel (referred to also as the stimulable phosphor sheet) provided with a stimulable phosphor. With the radiation image recording and reproducing techniques, the stimulable phosphor of the radiation image storage panel is caused to absorb radiation, which carries image information of an object or which has been radiated out from a sample, and thereafter the stimulable phosphor is exposed to an electromagnetic wave (stimulating rays), such as visible light or infrared rays, which causes the stimulable phosphor to produce the fluorescence (i.e., to emit light) in proportion to the amount of energy stored thereon during its exposure to the radiation. The produced fluorescence (the emitted light) is photoelectrically detected to obtain an electric signal. The electric signal is then processed, and the processed electric signal is utilized for reproducing a visible image of the object or the sample.

The radiation image recording and reproducing techniques have the advantages in that a radiation image containing a large amount of information can be obtained with a markedly lower dose of radiation than in the conventional radiography utilizing a radiation film and an intensifying screen. Therefore, the radiation image recording and reproducing techniques are efficient particularly for direct medical radiography, such as the X-ray image recording for medical diagnosis.

Basically, the radiation image storage panel utilized for the radiation image recording and reproducing techniques comprises a substrate and a stimulable phosphor layer overlaid on one surface of the substrate. Ordinarily, the stimulable phosphor layer comprises a binder and stimulable phosphor particles dispersed in the binder. The stimulable phosphor has the properties such that, when the stimulable phosphor is caused to absorb radiation, such as X-rays, and is then exposed to the stimulating rays, the stimulable phosphor emits light in proportion to the amount of energy stored thereon during its exposure to the radiation. Therefore, when the radiation image storage panel is exposed to the radiation, which carries image information of an object or which has been radiated out from a sample, the stimulable phosphor layer of the radiation image storage panel absorbs the radiation in proportion to the dose of radiation, and a radiation image of the object or the sample is stored as an image of energy from the radiation on the radiation image storage panel. The radiation image storage panel is then exposed to the stimulating rays, and the image having been stored on the radiation image storage panel can be detected as the light emitted by the radiation image storage panel. The emitted light is detected photoelectrically to obtain an image signal, the image signal is processed, and the thus obtained processed image signal can then be utilized for reproducing the radiation image of the object or the sample as a visible image.

As described above, the radiation image recording and reproducing techniques are the advantageous image forming techniques. However, as in the cases of an intensifying screen employed in the conventional radiography, it is desired that the radiation image storage panel utilized for the radiation image recording and reproducing techniques has a high sensitivity and can yield an image of good image quality (with respect to sharpness, graininess, and the like).

Basically, the sensitivity of the radiation image storage panel depends upon a total light emission intensity of the stimulable phosphor, which is contained in the radiation image storage panel. The total light emission intensity depends upon light emission luminance of the stimulable phosphor itself and the content of the stimulable phosphor in the stimulable phosphor layer. In cases where the content of the stimulable phosphor in the stimulable phosphor layer is high, a high absorptivity is capable of being obtained with respect to the radiation, such as the X-rays. Therefore, in cases where the content of the stimulable phosphor in the stimulable phosphor layer is high, a high sensitivity is capable of being obtained, and the image quality (in particular, with respect to the graininess) is capable of being enhanced. In cases where the content of the stimulable phosphor in the stimulable phosphor layer is kept at a predetermined value, if the stimulable phosphor particles are packed closely in the stimulable phosphor layer, the thickness of the stimulable phosphor layer can be set to be thin. Therefore, in such cases, spreading of the stimulating rays due to scattering in the stimulable phosphor layer is capable of being minimized, and an image having a high sharpness is capable of being obtained.

As radiation image storage panels provided with a stimulable phosphor layer, in which a stimulable phosphor is packed closely, and processes for producing the radiation image storage panels, the applicant proposed radiation image storage panels, in which a void content in the stimulable phosphor layer has been reduced by performing compression processing on the stimulable phosphor layer, and processes for producing the radiation image storage panels. The proposed radiation image storage panels and the proposed processes for producing the radiation image storage panels are disclosed in, for example, Japanese Unexamined Patent Publication Nos. 59(1984)-126299 and 59(1984)-126300.

With the proposed radiation image storage panels, the stimulable phosphor layer is subjected to the compression processing, the density of the stimulable phosphor in the stimulable phosphor layer is thereby set at a higher value than in conventional radiation image storage panels, and nonuniformity in stimulable phosphor density in the stimulable phosphor layer is thereby reduced. As a result, an image having a high sharpness is capable of being obtained with the proposed radiation image storage panels.

However, subsequent research revealed that, with the compression processing alone, nonuniformity in stimulable phosphor density in the stimulable phosphor layer cannot always be eliminated perfectly. It has thus been found that an improvement should be made even further with respect to nonuniformity in light emission of the radiation image storage panel due to nonuniformity in stimulable phosphor density.

The inventors conducted extensive research with regard to techniques for preparing a coating composition for the formation of the stimulable phosphor layer and found that it is markedly efficient to employ a mixed solvent, which comprises at least two kinds of organic solvents having different boiling temperatures and different viscosities, as an organic solvent for use in preparation of the coating composition for the formation of the stimulable phosphor layer. The present invention is based on such findings.

SUMMARY OF THE INVENTION

The primary object of the present invention is to provide a process for producing a radiation image storage panel, wherein a stimulable phosphor layer having uniform stimulable phosphor density is capable of being obtained, and a radiation image storage panel exhibiting little nonuniformity in light emission is capable of being produced.

The present invention provides a process for producing a radiation image storage panel, comprising the steps of:

i) preparing a coating composition comprising at least a stimulable phosphor, a binder, and a mixed solvent, which comprises a low boiling temperature solvent having a viscosity of at most 0.6 mPa·s and a high boiling temperature solvent having a viscosity higher than 0.6 mPa·s, boiling temperatures of the low boiling temperature solvent and the high boiling temperature solvent being different by at least 10° C. from each other, ii) applying the coating composition onto a substrate, and iii) drying the coating composition, which has been applied onto the substrate, a stimulable phosphor layer being thereby formed on the substrate.

The term "viscosity" as used herein means the viscosity measured with a capillary viscometer, a homocentric cylinder viscometer, or a cone-and-plate viscometer at room temperature (20° C.)

In the process for producing a radiation image storage panel in accordance with the present invention, the boiling temperature of the low boiling temperature solvent should preferably be at most 110° C., and the boiling temperature of the high boiling temperature solvent should preferably fall within the range of 110° C. to 220° C.

Also, a proportion of the low boiling temperature solvent with respect to a total amount of the mixed solvent should preferably fall within the range of 10% by weight to 90% by weight, and should more preferably fall within the range of 20% by weight to 80% by weight.

Further, the mixed solvent should preferably be at least one kind of mixed solvent selected from the group consisting of a ketone type of solvent, an ester type of solvent, and an alcohol type of solvent.

Furthermore, the low boiling temperature solvent should preferably be a solvent selected from the group consisting of methyl ethyl ketone and ethyl acetate.

Also, the high boiling temperature solvent should preferably be a solvent selected from the group consisting of n-butyl acetate, diacetone alcohol, and ethyl acetoacetate.

Further, the binder should preferably be a polyurethane resin.

The term "substrate" as used herein means both the substrate (i.e., the final substrate) of the radiation image storage panel, and a temporary substrate utilized in a process, in which the coating composition for the formation of the stimulable phosphor layer is firstly applied onto the temporary substrate and dried to form a phosphor sheet, and the thus formed phosphor sheet is then separated from the temporary substrate and adhered to the final substrate.

The process for producing a radiation image storage panel in accordance with the present invention should preferably be modified such that, after the coating composition has been applied onto the substrate and dried to form the stimulable phosphor layer, the thus formed stimulable phosphor layer is subjected to compression processing.

With the process for producing a radiation image storage panel in accordance with the present invention, the mixed solvent, which comprises the low boiling temperature solvent having a viscosity of at most 0.6 mPa·s and the high boiling temperature solvent having a viscosity higher than 0.6 mPa·s, boiling temperatures of the low boiling temperature solvent and the high boiling temperature solvent being different by at least 10° C. from each other, is employed as the solvent in the coating composition for the formation of the stimulable phosphor layer. Therefore, in the coating composition for the formation of the stimulable phosphor layer, which coating composition has been prepared by utilizing the mixed solvent, particles of the stimulable phosphor are capable of being dispersed uniformly. Accordingly, in the stimulable phosphor layer, which has been formed from the coating composition, the stimulable phosphor density becomes uniform. As a result, a radiation image storage panel exhibiting little nonuniformity in light emission is capable of being produced.

Specifically, in cases where the low boiling temperature solvent alone is utilized as the solvent in the coating composition for the formation of the stimulable phosphor layer, due to a quick evaporation rate of the low boiling temperature solvent, a homogeneous coating film cannot always be obtained. In cases where the high boiling temperature solvent alone is utilized as the solvent in the coating composition for the formation of the stimulable phosphor layer, since a long drying time is required, it is necessary to make adjustments for setting the coating period at a long period or providing a long drying zone. Also, ordinarily, binder resins (in particular, the polyurethane resins preferable as the binder resins) exhibit a low solubility with respect to the high boiling temperature solvent. Therefore, in cases where the high boiling temperature solvent alone is utilized as the solvent in the coating composition for the formation of the stimulable phosphor layer, it often occurs that the dispersibility of the stimulable phosphor particles becomes low, and nonuniformity in stimulable phosphor density in the stimulable phosphor layer occurs markedly. However, with the process for producing a radiation image storage panel in accordance with the present invention, the mixed solvent, which comprises the low boiling temperature solvent having a viscosity of at most 0.6 mPa·s and the high boiling temperature solvent having a viscosity higher than 0.6 mPa·s, boiling temperatures of the low boiling temperature solvent and the high boiling temperature solvent being different by at least 10° C. from each other, is employed as the solvent in the coating composition for the formation of the stimulable phosphor layer. Therefore, nonuniformity is capable of being prevented from occurring due to quick drying and flow in the drying zone for the coating film formed from the coating composition. Accordingly, a uniform and smooth stimulable phosphor layer is capable of being obtained, and a radiation image storage panel exhibiting little nonuniformity in light emission is capable of being produced.

With the process for producing a radiation image storage panel in accordance with the present invention, the stimulable phosphor particles are capable of being uniformly dispersed in the coating composition for the formation of the stimulable phosphor layer. After the coating composition has been applied onto the substrate and dried to form the coating layer (i.e., the stimulable phosphor layer), the thus formed stimulable phosphor layer may be subjected to compression processing. In such cases, the stimulable phosphor layer is compressed uniformly. Therefore, a packing rate of the stimulable phosphor in the stimulable phosphor layer is capable of being enhanced uniformly.

DETAILED DESCRIPTION OF THE INVENTION

The mixed solvent, which is employed in the process for producing a radiation image storage panel in accordance with the present invention, is the mixed solvent, which comprises the low boiling temperature solvent having a viscosity of at most 0.6 mPa·s and the high boiling temperature solvent having a viscosity higher than 0.6 mPa·s, boiling temperatures of the low boiling temperature solvent and the high boiling temperature solvent being different by at least 10° C. from each other. The boiling temperature of the low boiling temperature solvent should preferably be at most 110° C., and the boiling temperature of the high boiling temperature solvent should preferably fall within the range of 110° C. to 220° C. If the viscosity of the low boiling temperature solvent is higher than 0.6 mPa·s, even though the boiling temperature of the low boiling temperature solvent is at most 110° C., the solubility of the binder in the low boiling temperature solvent and the dispersibility of the stimulable phosphor will become low. Also, if the viscosity of the high boiling temperature solvent is at most 0.6 mPa·s, even though the boiling temperature of the high boiling temperature solvent is higher than 110° C., a homogeneous coating film cannot be obtained.

It is necessary that the difference between the boiling temperatures of the low boiling temperature solvent and the high boiling temperature solvent be at least 10° C. The difference between the boiling temperatures of the low boiling temperature solvent and the high boiling temperature solvent should preferably fall within the range of 20° C. to 100° C.

From the view points of the boiling temperature, the viscosity, good dissolving properties with respect to the binder, non-toxic and non-detrimental effects upon human bodies, non-coloring effects, no adverse effects of lowering the light emission efficiency of the stimulable phosphor, and a low cost, the organic solvent employed in the process for producing a radiation image storage panel in accordance with the present invention should preferably be selected from the group consisting of the ketone type of solvent, the ester type of solvent, and the alcohol type of solvent.

Examples of the organic solvents having a boiling temperature of at most 110° C. and a viscosity of at most 0.6 mPa·s (i.e., the low viscosity, low boiling temperature organic solvents) include ethyl acetate, methyl ethyl ketone (MEK), isopropyl acetate, and n-propyl acetate. Among the above-enumerated low viscosity, low boiling temperature organic solvents, MEK and ethyl acetate are particularly preferable. Examples of the organic solvents having a boiling temperature higher than 110° C. and a viscosity higher than 0.6 mPa·s (i.e., the high viscosity, high boiling temperature organic solvents) include isobutyl acetate, n-butyl acetate, isoamyl acetate, diacetone alcohol, and ethyl acetoacetate. Among the above-enumerated high viscosity, high boiling temperature organic solvents, n-butyl acetate, diacetone alcohol, and ethyl acetoacetate are particularly preferable. The proportion of the low viscosity, low boiling temperature solvent with respect to the total amount of the mixed solvent should preferably fall within the range of 10% by weight to 90% by weight, and should more preferably fall within the range of 20% by weight to 80% by weight.

Stimulable phosphors capable of being employed in the process for producing a radiation image storage panel in accordance with the present invention will be described hereinbelow.

As described above, the stimulable phosphor has the properties such that, when the stimulable phosphor is exposed to radiation and is then exposed to stimulating rays, the stimulable phosphor emits light in proportion to the amount of energy stored thereon during its exposure to the radiation. From the practical aspect, the stimulable phosphor should preferably have the characteristics such that, when the stimulable phosphor is exposed to the stimulating rays having wavelengths falling within the range of 400 nm to 900 nm, the stimulable phosphor emits light having wavelengths falling within the range of 300 nm to 500 nm. Examples of the stimulable phosphors, which may be employed in the process for producing a radiation image storage panel in accordance with the present invention, include the following:

a phosphor represented by the formula $BaSO_4$:AX, as described in Japanese Unexamined Patent Publication No. 48(1973)-80487, a phosphor represented by the formula $SrSO_4$:AX, as described in Japanese Unexamined Patent Publication No. 48(1973)-80489, a phosphor represented by the formula $Li_2B_4O_7$:Cu, Ag, as described in Japanese Unexamined Patent Publication No. 53(1978)-39277, a phosphor represented by the formula $Li_2O.(B_2O_2)_x$:Cu; or $Li_2O.(B_2O_2)_x$:Cu, Ag, as described in Japanese Unexamined Patent Publication No. 54(1979)-47883, a phosphor represented by the formula SrS:Ce, Sm; SrS:Eu, Sm; $ThO_2$:Er; or $La_2O_2S$:Eu, Sm, as described in U.S. Pat. No. 3,859,527, a phosphor represented by the formula ZnS:Cu, Pb; $BaO.xAl_2O_3$:Eu wherein $0.8 \leqq x \leqq 10$; $M^{II}O.xSiO_2$:A wherein $M^{II}$ is Mg, Ca, Sr, Zn, Cd, or Ba, A is Ce, Tb, Eu, Tm, Pb, Tl, Bi, or Mn, and x is a number satisfying $0.5 \leqq x \leqq 2.5$; or LnOX:xA wherein Ln is at least one of La, Y, Gd, and Lu, X is at least one of Cl and Br, A is at least one of Ce and Tb, x is a number satisfying $0<x<0.1$, as disclosed in U.S. Pat. No. 4,236,078, a phosphor represented by the formula $(Ba_{1-x-y}, Mg_x, Ca_y)FX:aEu^{2+}$ wherein X is at least one of Cl and Br, x and y are numbers satisfying $0<x+y \leqq 0.6$ and $xy \neq 0$, and a is a number satisfying $10^{-6} \leqq a \leqq 5\times10^{-2}$, as disclosed in DE-OS No. 2,928,245, a phosphor represented by the formula $(Ba_{1-x}, M^{2+}_x)FX:yA$ wherein $M^{2+}$ is at least one of Mg, Ca, Sr, Zn, and Cd, X is at least one of Cl, Br, and I, A is at least one of Eu, Tb, Ce, Tm, Dy, Pr, Ho, Nd, Yb, and Er, x is a number satisfying $0 \leqq x \leqq 0.6$, and y is a number satisfying $0 \leqq y \leqq 0.2$, as disclosed in U.S. Pat. No. 4,239,968, a phosphor represented by the formula BaFX:xCe.yA, as described in Japanese Unexamined Patent Publication No. 55(1980)-843897, a phosphor represented by the formula $M^{II}FX.xA:yLn$ wherein $M^{II}$ is at least one of Ba, Ca, Sr, Mg, Zn, and Cd, A is at least one of BeO, MgO, CaO, SrO, BaO, ZnO, $Al_2O_3$, $Y_2O_3$, $La_2O_3$, $In_2O_3$, $SiO_2$, $TiO_2$, $ZrO_2$, $GeO_2$, $SnO_2$, $Nb_2O_5$, $Ta_2O_5$, and $ThO_2$, Ln is at least one of Eu, Tb, Ce, Tm, Dy, Pr, Ho, Nd, Yb, Er, Sm, and Gd, X is at least one of Cl, Br, and I, x is a number satisfying $5\times10^{-5} \leqq x \leqq 0.5$, and y is a number satisfying $0<y \leqq 0.2$, as described in Japanese Unexamined Patent Publication No. 55(1980)-160078, a phosphor represented by the formula $(Ba_{1-x}, M^{II}_x)F_2.aBaX_2:yEu, zA$ wherein $M^{II}$ is at least one of beryllium, magnesium, calcium, strontium, zinc, and cadmium, X is at least one of chlorine, bromine, and iodine, A is at least one of zirconium and scandium, a is a number satisfying $0.5 \leqq a \leqq 1.25$, x is a number satisfying $0 \leqq x \leqq 1$, y is a number satisfying $10^{-6} \leqq y \leqq 2\times10^{-1}$, and z is a number satisfying $0<z \leqq 10^{-2}$, as described in Japanese Unexamined Patent Publication No. 56(1981)-116777, a phosphor represented by the formula $(Ba_{1-x}, M^{II}_x)F_2.aBaX_2:yEu, zB$ wherein $M^{II}$ is at least one of beryllium, magnesium, calcium, strontium, zinc, and cadmium, X is at least one of chlorine, bromine, and iodine, a is a number satisfying $0.5 \leqq a \leqq 1.25$, x is a number satisfying $0 \leqq x \leqq 1$, y is a number satisfying $10^{-6} \leqq y \leqq 2\times10^{-1}$, and z is a number satisfying $0<z \leqq 10^{-2}$, as described in Japanese Unexamined Patent Publication No. 57(1982)-23673, a phosphor represented by the formula $(Ba_{1-x}, M^{II})F_2.aBaX_2:yEu, zA$ wherein $M^{II}$ is at least one of beryllium, magnesium, calcium, strontium, zinc, and cadmium, X is at least one of chlorine, bromine, and iodine, A is at least one of arsenic and silicon, a is a number satisfying $0.5 \leqq a \leqq 1.25$, x is a number satisfying $0 \leqq x \leqq 1$, y is a number satisfying $10^{-6} \leqq y \leqq 2\times10^{-1}$, and z is a number satisfying $0<z \leqq 5\times10^{-1}$, as described in Japanese Unexamined Patent Publication No. 57(1982)-23675, a phosphor represented by the formula $M^{III}OX:xCe$ wherein $M^{III}$ is at least one trivalent metal selected from the group consisting of Pr, Nd, Pm, Sm, Eu, Tb, Dy, Ho, Er, Tm, Yb, and Bi, X is either one or both of Cl and Br, and x is a number satisfying $0<x<0.1$, as described in Japanese Unexamined Patent Publication No. 58(1983)-69281, a phosphor represented by the formula $Ba_{1-x}M_{x/2}L_{x/2}FX:yEu^{2+}$ wherein M is at least one alkaline metal selected from the group consisting of Li, Na, K, Rb, and Cs, L is at least one trivalent metal selected from the group consisting of Sc, Y, La, Ce, Pr, Nd, Pm, Sm, Gd, Tb, Dy, Ho, Er, Tm, Yb, Lu, Al, Ga, In, and Tl, X is at least one halogen selected from the group consisting of Cl, Br, and I, x is a number satisfying $10^{-2} \leqq x \leqq 0.5$, and y is a number satisfying $0<y \leqq 0.1$, as described in Japanese Unexamined Patent Publication No. 58(1983)-206678, a phosphor represented by the formula $BaFX.xA:yEu^{2+}$ wherein X is at least one halogen selected from the group consisting of Cl, Br, and I, A is a calcination product of a tetrafluoro boric acid compound, x is a number satisfying $10^{-6} \leqq x \leqq 0.1$, and y is a number satisfying $0<y \leqq 0.1$, as described in Japanese Unexamined Patent Publication No. 59(1984)-27980, a phosphor represented by the formula $xM_3(PO_4)_2.NX_2:yA$; $M_3(PO_4)_2:yA$; $nReX_3.mAX'_2:xEu$; $nReX_3.mAX'_2:xEu, ySm$; or $M^IX.aM^{II}X'_2.bM^{III}X''_3:cA$, as described in Japanese Unexamined Patent Publication No. 59(1984)-38278, a phosphor represented by the formula $BaFX.xA:yEu^{2+}$ wherein X is at least one halogen selected from the group consisting of Cl, Br, and I, A is a calcination product of at least one compound selected from the hexafluoro compound group consisting of salts of hexafluoro silicic acid, hexafluoro titanic acid, and hexafluoro zirconic acid with monovalent or bivalent metals, x is a number satisfying $10^{-6} \leqq x \leqq 0.1$, and y is a number satisfying $0<y \leqq 0.1$, as described in Japanese Unexamined Patent Publication No. 59(1984)-47289, a phosphor represented by the formula $BaFX.xNaX':aEu^{2+}$ wherein each of X and X' is at least one of Cl, Br, and I, x is a number satisfying $0<x \leqq 2$, and a is a number satisfying $0<a \leqq 0.2$, as described in Japanese Unexamined Patent Publication No. 59(1984)-56479, a phosphor represented by the formula $M^{II}FX.xNaX':yEu^{2+}:zA$ wherein $M^{II}$ is at least one alkaline earth metal selected from the group consisting of Ba, Sr, and Ca, each of X and X' is at least one halogen selected from the group consisting of Cl, Br, and I, A is at least one transition metal selected from the group consisting of V, Cr, Mn, Fe, Co, and Ni, x is a number satisfying $0<x \leqq 2$, y is a number satisfying $0<y \leqq 0.2$, and z is a number satisfying $0<z \leqq 10^{-2}$, as described in Japanese Unexamined Patent Publication No. 59(1984)-56480, a phosphor represented by the formula $M^{II}FX.aM^IX'.bM'^{III}X''_2.cM^{III}X'''_3.xA:yEu^{2+}$ wherein $M^{II}$ is at least one alkaline earth metal selected from the group consisting of Ba, Sr, and Ca, $M^I$ is at least one alkali metal selected from the group consisting of Li, Na, K, Rb, and Cs, $M'^{II}$, is at least one bivalent metal selected from the group consisting of Be and Mg, $M^{III}$ is at least one trivalent metal selected from the group consisting of Al, Ga, In, and Tl, A is a metal oxide, X is at least one halogen selected from the group consisting of Cl, Br, and I, each of X', X'', and X''' is at least one halogen selected from the group consisting of F, Cl, Br, and I, a is a number satisfying $0 \leqq a \leqq 2$, b is a number satisfying $0 \leqq b \leqq 10^{-2}$, c is a number satisfying $0 \leqq c \leqq 10^{-2}$, and $a+b+c \geqq 10^{-6}$, x is a number satisfying $0<x \leqq 0.5$, and y is a number satisfying $0<y \leqq 0.2$, as described in Japanese Unexamined Patent Publication No. 59(1984)-75200, a stimulable phosphor represented by the formula $M^{II}X_2.aM^{II}X'_2:xEu^{2+}$ wherein $M^{II}$ is at least one alkaline earth metal selected from the group consisting of Ba, Sr, and Ca, each of X and X' is at least one halogen selected from the group consisting of Cl, Br, and I, and $X \neq X'$, a is a number satisfying $0.1 \leqq a \leqq 10.0$, and x is a number satisfying $0<x \leqq 0.2$, as described in Japanese Unexamined Patent Publication No. 60(1985)-84381, a stimulable phosphor represented by the formula $M^{II}FX.aM^IX':xEu^{2+}$ wherein $M^{II}$ is at least one alkaline earth metal selected from the group consisting of Ba, Sr, and Ca, $M^I$ is at least one alkali metal selected from the group consisting of Rb and Cs, X is at least one halogen selected from the group consisting of Cl, Br, and I, X' is at least one halogen selected from the group consisting of F, Cl, Br, and I, a is a number satisfying $0 \leqq a \leqq 4.0$, and x is a number satisfying $0<x \leqq 0.2$, as described in Japanese Unexamined Patent Publication No. 60(1985)-101173, and a stimulable phosphor represented by the formula $M^IX:xBi$ wherein $M^I$ is at least one alkali metal selected from the group consisting of Rb and Cs, X is at least one halogen selected from the group consisting of Cl, Br, and I, and x is a number falling within the range of $0<x \leqq 0.2$, as described in Japanese Unexamined Patent Publication No. 62(1987)-25189.

The stimulable phosphor represented by the formula $M^{II}X_2.aM^{II}X'_2:xEu^{2+}$, which is described in Japanese Unexamined Patent Publication No. 60(1985)-84381, may contain the additives described below in the below-mentioned proportions per mol of $M^{II}X_2.aM^{II}X'_2$:

$bM^IX''$ wherein $M^I$ is at least one alkali metal selected from the group consisting of Rb and Cs, X'' is at least one halogen selected from the group consisting of F, Cl, Br, and I, and b is a number satisfying $0<b \leqq 10.0$, as described in Japanese Unexamined Patent Publication No. 60(1985)-166379, $bKX''.cMgX_2.dM^{III}X'_3$ wherein $M^{III}$ is at least one trivalent metal selected from the group consisting of Sc, Y, La, Gd, and Lu, each of X'', X, and X' is at least one halogen selected from the group consisting of F, Cl, Br, and I, b is a number satisfying $0 \leqq b \leqq 2.0$, c is a number satisfying $0 \leqq c \leqq 2.0$, d is a number satisfying $0 \leqq d \leqq 2.0$, and $2\times10^{-5} \leqq b+c+d$, as described in Japanese Unexamined Patent Publication No. 60(1985)-221483, yB wherein y is a number satisfying $2\times10^{-4} \leqq y \leqq 2\times10^{-1}$, as described in Japanese Unexamined Patent Publication No. 60(1985)-228592, bA wherein A is at least one oxide selected from the group consisting of $SiO_2$ and $P_2O_5$, and b is a number satisfying $10^{-4} \leqq b \leqq 2\times10^{-1}$, as described in Japanese Unexamined Patent Publication No. 60(1985)-228593, bSiO wherein b is a number satisfying $0<b \leqq 3\times10^{-2}$, as described in Japanese Unexamined Patent Publication No. 61(1986)-120883, $bSnX''_2$ wherein X" is at least one halogen selected from the group consisting of F, Cl, Br, and I, and b is a number satisfying $0<b \leqq 10^{-3}$, as described in Japanese Unexamined Patent Publication No. 61(1986)-120885, $bCsX''.cSnX_2$ wherein each of X" and X is at least one halogen selected from the group consisting of F, Cl, Br, and I, b is a number satisfying $0<b \leqq 10.0$, and c is a number satisfying $10^{-6} \leqq c \leqq 2\times10^{-2}$, as described in Japanese Unexamined Patent Publication No. 61(1986)-235486, and $bCsX''.yLn^{3+}$ wherein X" is at least one halogen selected from the group consisting of F, Cl, Br, and I, Ln is at least one rare earth element selected from the group consisting of Sc, Y, Ce, Pr, Nd, Sm, Gd, Tb, Dy, Ho, Er, Tm, Yb, and Lu, b is a number satisfying $0<b \leqq 10.0$, and y is a number satisfying $10^{-6} \leqq y \leqq 1.8\times10^{-1}$, as described in Japanese Unexamined Patent Publication No. 61(1986)-235487.

Of the above-enumerated stimulable phosphors, the bivalent europium activated alkaline earth metal halide phosphor and the cerium activated rare earth element oxyhalide phosphor exhibit light emission with a high luminance and therefore are particularly preferable. However, the stimulable phosphor employed in the process for producing a radiation image storage panel in accordance with the present invention is not limited to the phosphors enumerated above and may be one of various other phosphors, which have the properties such that, when the phosphors are exposed to radiation and are then exposed to stimulating rays, the phosphors emit light in proportion to the amount of energy stored thereon during exposure to the radiation.

As the binder utilized in the process for producing a radiation image storage panel in accordance with the present invention, a thermoplastic elastomer, which has elasticity at normal temperatures and which exhibits fluidity when being heated, should preferably be employed. As the elastomer, ordinarily, an elastomer having a softening temperature or a melting temperature falling within the range of 30° C. to 300° C. is ordinarily employed. An elastomer having a softening temperature or a melting temperature falling within the range of 30° C. to 200° C. is more preferable. An elastomer having a softening temperature or a melting temperature falling within the range of 30° C. to 150° C. is most preferable. Examples of the thermoplastic elastomers include a polystyrene, a polyolefin, a polyurethane, a polyester, a polyamide, a polybutadiene, an ethylene-vinyl acetate copolymer, a polyvinyl chloride, natural rubber, fluorine rubber, a polyisoprene, a chlorinated polyethylene, a styrene-butadiene rubber, and silicone rubber. Of the above-enumerated thermoplastic elastomers, the polyurethane resin is more preferable from the view point of the dispersibility of the stimulable phosphor and the strength of the stimulable phosphor layer.

The binder described above, the stimulable phosphor described above, and the mixed solvent are mixed together sufficiently. In this manner, the coating composition, in which the stimulable phosphor has been dispersed uniformly in a binder solution, is prepared.

The mixing ratio of the binder to the stimulable phosphor in the coating composition varies for different characteristics desired for the radiation image storage panel, different kinds of the phosphors, and the like. Ordinarily, the mixing ratio of the binder to the stimulable phosphor is selected from the range between 1:1 and 1:100 (weight ratio). The mixing ratio of the binder to the phosphor should preferably be selected from the range between 1:8 and 1:40 (weight ratio).

The coating composition may also contain various additives, such as dispersing agents for enhancing dispersibility of the stimulable phosphor in the coating composition and plasticizers for enhancing the binding force between the binder and the phosphor in the phosphor layer after being formed. Examples of the dispersing agents utilized for such purposes include phthalic acid, stearic acid, caproic acid, phenyl phosphonic acid, various phosphoric acid esters, and lipophilic surface-active agents. Examples of the plasticizers utilized for such purposes include phosphoric acid esters, such as triphenyl phosphate, tricresyl phosphate, and diphenyl phosphate; phthalic acid esters, such as diethyl phthalate and dimethoxyethyl phthalate; glycolic acid esters, such as ethylphthalylethyl glycolate and butylphthalylbutyl glycolate; and polyesters of a polyethylene glycol with an aliphatic dibasic acid, such as a polyester of triethylene glycol with adipic acid, and a polyester of diethylene glycol with succinic acid.

The coating composition, which contains the stimulable phosphor and the binder and has been prepared in the manner described above, is uniformly applied onto a surface of a substrate or a temporary substrate and is then dried. The operation for applying the coating composition onto the substrate or the temporary substrate may be performed by utilizing ordinary coating means, such as an extrusion coater, a slide coater, a doctor blade, a roll coater, or a knife coater.

By way of example, each of the substrate and the temporary substrate may be constituted of a material selected from a glass plate, a metal plate, various kinds of materials, which are employed as substrates for intensifying paper (or an intensifying screen) in the conventional radiography, and materials known as substrates for radiation image storage panels. Examples of the materials for the temporary substrates include films of plastic materials, such as cellulose acetate, a polyethylene terephthalate, a polyethylene naphthalate, a polyamide, a polyimide, and a polycarbonate; metal sheets, such as aluminum foil and an aluminum alloy foil; paper, such as ordinary paper, baryta paper, resin-coated paper, pigment paper containing a pigment, such as titanium dioxide, and paper sized with a polyvinyl alcohol, or the like; and plates or sheets of ceramic materials, such as alumina, zirconia, magnesia, and titania.

In conventional radiation image storage panels, such that the binding strength between the substrate and the stimulable phosphor layer may be enhanced, or such that the sensitivity of the radiation image storage panel may be enhanced or an image having good image quality (with respect to sharpness and graininess) may be obtained with the radiation image storage panel, a high-molecular weight substance, such as a soft polyester substance or a soft acrylic substance, is applied onto the surface of the substrate, on which surface the stimulable phosphor layer is to be overlaid, in order to form an adhesive properties imparting layer, or a light reflecting layer constituted of a light reflecting substance, such as titanium dioxide, a light absorbing layer constituted of a light absorbing substance, such as carbon black, or the like, is formed on the surface of the substrate, on which surface the stimulable phosphor layer is to be overlaid. In the process for producing a radiation image storage panel in accordance with the present invention, various such layers may be formed on the substrate. The layer constitution may be selected arbitrarily in accordance with the characteristics which the radiation image storage panel should have, and the like.

Also, as described in Japanese Unexamined Patent Publication No. 59(1984)-200200, such that an image having a high sharpness maybe obtained, fine concavities and convexities may be formed on the surface of the substrate, on which surface the stimulable phosphor layer is to be overlaid. (In cases where the adhesive properties imparting layer, the light reflecting layer, the light absorbing layer, or the like, is formed on the surface of the substrate, on which surface the stimulable phosphor layer is to be overlaid, fine concavities and convexities may be formed on the surface of the layer formed on the substrate.).

In cases where a phosphor sheet acting as the stimulable phosphor layer of the radiation image storage panel is to be formed on the temporary substrate, the coating composition for the formation of the stimulable phosphor layer is applied onto the temporary substrate and dried to form the phosphor sheet. Thereafter, the phosphor sheet is separated from the temporary substrate and adhered as the stimulable phosphor layer to the final substrate. Therefore, before the coating composition for the formation of the phosphor layer is applied onto the temporary substrate, a releasing agent should preferably be applied onto the surface of the temporary substrate, such that the phosphor sheet having been formed on the temporary substrate can easily be separated from the temporary substrate.

In the process for producing a radiation image storage panel in accordance with the present invention, after the coating composition for the formation of the stimulable phosphor layer has been applied onto the substrate and dried to form the stimulable phosphor layer, a coating composition for the formation of a protective film, which will be described later, should preferably be applied onto the thus formed stimulable phosphor layer and dried. Alternatively, the stimulable phosphor layer should preferably be covered with a sheet-like protective film, and the combination of the stimulable phosphor layer and the sheet-like protective film should preferably be compressed at a temperature equal to at least a softening temperature of the binder. In cases where the coating composition for the formation of the stimulable phosphor layer has been applied onto the temporary substrate and dried to form the phosphor sheet, after the phosphorsheet has been separated from the temporary substrate and located on the substrate, the phosphor sheet, which has been located on the substrate, should preferably be compressed at a temperature equal to at least the softening temperature or a melting temperature of the binder, such that the phosphor sheet and the substrate may be adhered to each other.

Examples of compression apparatuses, which may be utilized for the compression processing in the process for producing a radiation image storage panel in accordance with the present invention, include known compression apparatuses, such as a calender roll apparatus and a hot press. However, the compression apparatuses, which may be utilized for the compression processing in the process for producing a radiation image storage panel in accordance with the present invention, are not limited to the compression apparatuses described above and may be selected from various other compression apparatuses, with which the sheet of the type described above can be heated and compressed. Ordinarily, the pressure, under which the compression processing is performed, is at least 5 MPa.

Ordinary, in radiation image storage panels, a transparent protective film for physically and chemically protecting the stimulable phosphor layer is overlaid upon the surface of the stimulable phosphor layer, which surface is opposite to the surface in contact with the substrate. In the process for producing a radiation image storage panel in accordance with the present invention, the radiation image storage panel should preferably be also provided with the transparent protective film.

The transparent protective film may be constituted of a cellulose derivative, such as cellulose acetate or nitro cellulose; or a transparent high-molecular substance, e.g., a synthetic high-molecular substance, such as a polymethyl methacrylate, a polyvinyl butyral, a polyvinyl formal, a polycarbonate, a polyvinyl acetate, or a vinyl chloride-vinyl acetate copolymer. The transparent protective film may be formed by applying a solution, which contains one of the above-enumerated materials in an appropriate solvent, onto the surface of the stimulable phosphor layer. Alternatively, the transparent protective film may be formed by preparing a protective film forming sheet and adhering the protective film forming sheet to the surface of the stimulable phosphor layer by use of an appropriate adhesive agent. The protective film forming sheet may be constituted of a plastic sheet formed from a polyethylene terephthalate, a polyethylene naphthalate, a polyethylene, a polypropylene, a polyvinylidene chloride, or a polyamide; or a transparent glass plate. Ordinarily, the thickness of the protective film should preferably fall within the range of approximately 0.1 μm to approximately 20 μm.

Further, such that the sharpness of the obtained image may be enhanced, a colored layer, which absorbs the stimulating rays and does not absorb the light emitted by the stimulable phosphor, may be added at least to one of the layers described above. (The colored layer is described in, for example, Japanese Patent Publication No. 59(1984)-23400.).

The present invention will further be illustrated by the following non-limitative examples. Table 1 below shows the boiling temperatures and the viscosities of the low boiling temperature solvents and the high boiling temperature solvents employed in Examples and Comparative Examples described below.

TABLE 1

| Solvent | Boiling temperature | Viscosity (mPa · s) |
|---|---|---|
| Low boiling Temperature Solvent | | |
| Ethyl acetate | 77 | 0.44 |
| MEK | 80 | 0.42 |
| n-Propyl acetate | 102 | 0.58 |
| High boiling Temperature Solvent | | |
| Toluene | 111 | 0.59 |
| n-Butyl acetate | 127 | 0.74 |
| Diacetone alcohol | 168 | 3.20 |
| Ethyl acetoacetate | 180 | 1.51 |

EXAMPLE 1

Firstly, a phosphor sheet acting as a stimulable phosphor layer was prepared in the manner described below. A coating composition for forming a phosphor sheet was prepared in the manner described below. Specifically, 1,000 parts by weight of a phosphor (a phosphor represented by the formula $BaFBr_{0.85}I_{0.15}:Eu^{2+}$), 236.6 parts by weight of a polyurethane resin [a refined product of Pandex T-5205, a 15% solution, supplied by Dainippon Ink and Chemicals, Inc.] acting as a binder, 4.5 parts by weight of a polyisocyanate [Coronate HX (solid content: 100%), supplied by Nippon Polyurethane K.K.] acting as a crosslinking agent, 20.0 parts by weight of an epoxy resin [a 50% solution of EP1001, supplied by Yuka Shell Epoxy K.K.] acting as an anti-yellowing agent, and 0.02 part by weight of ultramarine blue (SM-1, supplied by Daiichi Kasei Kogyo K.K.) acting as a coloring agent were added to a MEK/n-butyl acetate mixed solvent (MEK:n-butyl acetate=7:3). The resulting mixture was subjected to dispersing processing, which was performed with a "disper" apparatus. In this manner, the coating composition having a viscosity of 3 Pa·s (20° C.) was prepared. The thus prepared coating composition was applied onto a polyethylene terephthalate sheet (a temporary substrate, having a thickness of 180 μm), on which a silicone type releasing agent had been applied. The applied coating composition was then dried and separated from the temporary substrate. In this manner, a phosphor sheet having a thickness of 250 μm was prepared.

Thereafter, a reflecting layer (a prime-coating layer) was formed in the manner described below. Specifically, 30 parts by weight of fine particles of gadolinium oxide ($Gd_2O_3$) (in which the particle diameters of 90 wt % particles among all particles fell within the range of 1 μm to 5 μm), 30 parts by weight of a soft acrylic resin [Criscoat P-1018GS (20% solution), supplied by Dainippon Ink and Chemicals, Inc.] acting as a binder, 3.5 parts by weight of a phthalic acid ester, 10 parts by weight of ZnO whisker acting as a conductive agent, and 0.4 parts by weight of ultramarine blue acting as a coloring agent were added to MEK (methyl ethyl ketone). The resulting mixture was subjected to dispersing and mixing processing, which was performed with a "disper" apparatus. In this manner, a coating composition for the formation of the reflecting layer (the prime-coating layer) was prepared. The coating composition for the formation of the reflecting layer (the prime-coating layer) was then uniformly applied onto a polyethylene terephthalate substrate having a thickness of 300 μm). The coating film of the coating composition was then dried. In this manner, the reflecting layer having a thickness of 20 μm was formed on the substrate.

Thereafter, the phosphorsheet, which had been prepared previously, was located on the reflecting layer, which had been formed on the substrate. The combination of the phosphor sheet, the reflecting layer, and the substrate was then subjected to compression processing. The compression processing was performed continuously with a calender roll apparatus under the conditions of a pressure of 50 MPa, an upper roll temperature of 90° C., a lower roll temperature of 75° C., and a feed rate of 2.0 m/min. With the compression processing, the phosphor sheet acting as the stimulable phosphor layer and the substrate were perfectly fused together. The thickness of the stimulable phosphor layer after being fused to the substrate was 220 μm.

Thereafter, a protective film was formed in the manner described below. Specifically, 50 parts by weight of a fluoro olefin-vinyl ether copolymer [Lumiflon LF-504X (40% solution) supplied by Asahi Glass Co., Ltd.] acting as a fluorine type of resin, 9 parts by weight of a polyisocyanate [Sumidur N3500, supplied by Sumitomo Chemical Co., Ltd.] acting as a crosslinking agent, 0.5 part by weight of an alcohol-modified silicone [X-22-2809 (66% solution), supplied by Shin-Etsu Chemical Co., Ltd.] acting as a lubricant, 0.003 part by weight of dibutyltin dilaurate (KS1260, supplied by Kyodo Yakuhin K.K.) acting as a catalyst, and 10 parts by weight of melamine resin particles (Eposter S6) were added to MEK. In this manner, a coating composition having a viscosity of 30 mPa·s was prepared. The thus prepared coating composition was then applied onto a 9 μm-thick polyethylene terephthalate film. The applied coating composition was subjected to heat treatment at 120° C. for 30 minutes and was thereby thermally cured and dried to form a coating layer. Thereafter, a polyester type of adhesive agent layer was formed on the back surface of the 9 μm-thick polyethylene terephthalate film having been provided with the coating layer. Also, the adhesive agent layer and the stimulable phosphor layer, which had been formed previously on the substrate, were adhered together with the application of heat and pressure at 100° C. and 5 MPa. In this manner, the protective film was formed on the stimulable phosphor layer.

Finally, an edge covering film was formed in the manner described below. Specifically, 70 parts by weight of a silicone type of polymer [a polyurethane having a polydimethylsiloxane unit; Daiallomer SP-3023 (15 wt % solution in MEK/toluene mixed solvent), supplied by Dainichi Seika K.K.], 3 parts by weight of a polyisocyanate [Crossnate D-70 (50 wt % solution), supplied by Dainichi Seika K.K.] acting as a crosslinking agent, 0.6 part by weight of an epoxy resin [EP1001 (solid), supplied by Yuka Shell Epoxy K.K.] acting as an anti-yellowing agent, and 0.2 part by weight of an alcohol-modified silicone [X-22-2809 (66% solution), supplied by Shin-Etsu Chemical Co., Ltd.] acting as a lubricant were added to and dissolved in 15 parts by weight of MEK, and a coating composition for the formation of the edge covering film was thereby prepared. The thus prepared coating composition was then applied onto side faces of the panel, which had been formed in the manner described above and which had been constituted of the substrate, the prime-coating layer, the stimulable phosphor layer, and the protective layer. The thus applied coating composition was then dried sufficiently at room temperature, and a hardened edge covering film having a thickness of 25 μm was thereby formed. In the manner described above, a radiation image storage panel, which had been constituted of the substrate, the prime-coating layer, the stimulable phosphor layer, the protective layer, and the hardened edge covering film, was produced.

EXAMPLES 2 TO 7 AND COMPARATIVE EXAMPLES 1 TO 4

In Examples 2 to 7 and Comparative Examples 1 to 4, radiation image storage panels were produced in the same manner as that in Example 1, except that the stimulable phosphor layers were prepared by use of the mixed solvents or solvents listed in Table 2 shown below. In Table 2, in cases where only a single solvent was utilized as the solvent, only the single solvent is shown as the solvent.

TABLE 2

| | Solvent |
|---|---|
| Example 1 | MEK/n-butyl acetate (7:3) |
| Example 2 | MEK/n-butyl acetate (5:5) |
| Example 3 | MEK/n-butyl acetate (3:7) |
| Example 4 | MEK/diacetone alcohol (8:2) |

TABLE 2-continued

| | Solvent |
|---|---|
| Example 5 | MEK/ethyl acetoacetate (8:2) |
| Example 6 | Ethyl acetate/n-butyl acetate (5:5) |
| Example 7 | MEK/n-butyl acetate/diacetone alcohol (6:3:1) |
| Comp. Ex. 1 | MEK |
| Comp. Ex. 2 | MEK/toluene (7:3) |
| Comp. Ex. 3 | Ethyl acetate |
| Comp. Ex. 4 | n-Butyl acetate |

(Evaluation of image quality obtained with radiation image storage panel)

The image quality obtained with the radiation image storage panel was evaluated in the manner described below. Specifically, X-rays produced at a tube voltage of 80 kVp were uniformly irradiated to the radiation image storage panel. Thereafter, the radiation image storage panel was scanned with a He—Ne laser beam (wavelength: 632.8 nm) acting as stimulating rays, and the stimulable phosphor contained in the radiation image storage panel was thereby stimulated. Light, which was emitted by the stimulable phosphor layer when the stimulable phosphor layer was exposed to the He—Ne laser beam, was received and converted into an electric signal. A visible image was then reproduced from the electric signal by utilizing an image reproducing apparatus, and the reproduced image was displayed on a display device. The amount of the light emitted by the stimulable phosphor layer was measured. (The amount of the emitted light was represented by a relative value with the amount of the emitted light obtained from the radiation image storage panel of Comparative Example 1 being taken as 100.) Also, the sharpness was measured in terms of the modulation transfer function (MTF) (frequency: 2 cycles/mm) of the obtained image. Further, the graininess (RM) at an x-ray dose of 0.1 mR was measured. Furthermore, as for nonuniformity in light emission, the amount of the emitted light was measured with respect to a plurality of positions on the radiation image storage panel, and a difference between the maximum value and the minimum value of the amount of the emitted light was represented in %. The results shown in Table 3 below were obtained.

TABLE 3

| | Amount of emitted light | Nonuniformity in light emission(%) | Sharpness | Graininess |
|---|---|---|---|---|
| Example 1 | 101 | 1 | 36 | 0.024 |
| Example 2 | 101 | 1 | 36 | 0.024 |
| Example 3 | 100 | 2 | 36 | 0.025 |
| Example 4 | 101 | 1 | 37 | 0.024 |
| Example 5 | 101 | 2 | 37 | 0.025 |
| Example 6 | 101 | 1 | 36 | 0.025 |
| Example 7 | 101 | 1 | 37 | 0.023 |
| Comp. Ex. 1 | 100 | 4 | 36 | 0.026 |
| Comp. Ex. 2 | 101 | 6 | 36 | 0.025 |
| Comp. Ex. 3 | 100 | 8 | 34 | 0.028 |
| Comp. Ex. 4 | The polyurethane resin could not be dissolved, and phosphor particles could not be dispersed | | | |

As clear from the results shown in Table 3, with the radiation image storage panels having been produced with the process in accordance with the present invention, wherein the stimulable phosphor layer was formed by use of the mixed solvent defined in the present invention, the characteristics with respect to the amount of the emitted light, the sharpness, and the graininess were equivalent to or better than the characteristics of the conventional radiation image storage panel of Comparative Example 1, in which MEK alone was utilized as the solvent in the coating composition for the formation of the stimulable phosphor layer, the conventional radiation image storage panel of Comparative Example 3, in which ethylacetate alone was utilized as the solvent, and the conventional radiation image storage panel of Comparative Example 2, in which the MEK/toluene mixed solvent was utilized as the solvent. Also, with the radiation image storage panels having been produced with the process in accordance with the present invention, wherein the stimulable phosphor layer was formed by use of the mixed solvent defined in the present invention, nonuniformity in light emission could be reduced to one half or less. Specifically, with the process for producing a radiation image storage panel in accordance with the present invention, a radiation image storage panel having good quality and exhibiting little nonuniformity in light emission could be obtained.

As clear from the results described above, with the process for producing a radiation image storage panel in accordance with the present invention, wherein the stimulable phosphor layer is formed by use of the mixed solvent defined in the present invention, a radiation image storage panel exhibiting little nonuniformity in light emission by virtue of good dispersibility of the stimulable phosphor particles is capable of being produced easily.

What is claimed is:

1. A process for producing a radiation image storage panel, comprising the steps of:

i) preparing a coating composition comprising at least a bivalent europium activated alkaline earth metal halide phosphor, a polyurethane resin binder, and a mixed solvent, which comprises a low boiling temperature solvent having a viscosity of at most 0.6 mPa·s and a high boiling temperature solvent having a viscosity higher than 0.6 mPa·s, boiling temperatures of the low boiling temperature solvent and the high boiling temperature solvent being different by at least 10° C. from each other, wherein the high boiling temperature solvent is n-butyl acetate and the low boiling temperature solvent is methyl ethyl ketone, and wherein a proportion of the methyl ethyl ketone with respect to the total amount of the mixed solvent is within a range of 30% by weight to 70% by weight, ii) applying the coating composition onto a substrate, and iii) drying the coating composition, which has been applied onto the substrate, to remove the mixed solvent, a stimulable phosphor layer being thereby formed on the substrate.

2. A process as defined in claim 1 wherein, after the coating composition has been applied onto the substrate and dried to form the stimulable phosphor layer, the thus formed stimulable phosphor layer is subjected to compression processing.

* * * * *